United States Patent [19]

Creasey

[11] 4,187,830

[45] Feb. 12, 1980

[54] FIREPLACE INSERT

[76] Inventor: Leon D. Creasey, 5750 Hoffman La., Fair Oaks, Calif. 95828

[21] Appl. No.: 871,194

[22] Filed: Jan. 23, 1978

[51] Int. Cl.[2] ..... F24B 7/00

[52] U.S. Cl. ..... 126/121; 126/131; 126/164

[58] Field of Search ..... 126/121, 129, 131, 135, 126/143, 164, 165; D23/94, 96, 127; 237/57

[56] References Cited

U.S. PATENT DOCUMENTS

| | | | |
|---|---|---|---|
| 1,740,996 | 12/1929 | Muir | 126/121 |
| 1,783,140 | 11/1930 | Quinliven | 126/121 |
| 4,018,210 | 4/1977 | Christophel | 126/164 |
| 4,056,091 | 11/1977 | Moncrieff-Yeates | 126/121 |

*Primary Examiner*—Carroll B. Dority, Jr.
*Assistant Examiner*—Lee E. Barrett
*Attorney, Agent, or Firm*—Mark C. Jacobs

[57] ABSTRACT

A generally U-shaped hollow chamber fireplace insert having a central section and two side sections. Each side section has top and bottom openings on the front wall for air exit and entry respectively.

Secured to openings at least at the bottom of the inside wall of the center section are air delivery tubes. In one embodiment a smoke shield is also provided.

13 Claims, 7 Drawing Figures

FIREPLACE INSERT

The present invention relates to prefabricated fireplace insert units and more particularly to insert units for discharging heated air into the room to be heated.

In these times of energy crisis, people have become more aware of the necessary of utilizing greater portions of the heat available from their fireplace for heating purposes. Most of the air heated by a fire in the fireplace is drawn up the chimney, and the heat transmitted to the room is almost all together transmitted by direct radiation. A more efficient heating system is desired for the fireplace user.

It is an object of this invention to provide a simple efficient prefabricated device adapted to fit fireplaces of different sizes which will heat regional air and discharge it into the desired area to be heated.

It is a further object to provide a simple and efficient auxiliary air heating device to fit into a fireplace which comprises a plurality of sections adapted to fit together such that the device can be modified to be employed in the fireplace of varying homes.

It is also an object of the invention to provide an auxiliary heating unit for use in a fireplace which has rigidly dimensioned walls and which constitutes an improvement over previously known fireplace insert units.

It is a yet further object of the invention to provide an auxiliary air heating device comprising a casing having spaced walls forming an air chamber wherein air is directed by a plurality of air guides in said chamber from a combustion area to an outlet area. The unit of this invention is seen to have air tubes at least on the inlet portion of the device which are positioned strategically within the fire area.

Still another object is provide a fireplace insert device wherein the device further includes complimentary air outlet members strategically positioned above the fire area. Preferably such auxiliary air outlet tubes also include a smoke shield to maintain any smoke that impinges upon said outlet tubes from being dispersed into the room to be heated.

Other objects of the invention will in part be obvious and will in part appear herein after. The invention accordingly comprises the features of construction, combination of elements, and arrangement in parts which will be exemplified in this construction herein after recited, and the scope of the invention of which will be indicated in the appended claims.

For a fuller understanding of the nature of the objects of the instant invention reference should be had to the following detailed disclosure taken in connection with the accompanying drawings, wherein.

SUMMARY OF THE INVENTION

Figure 1:
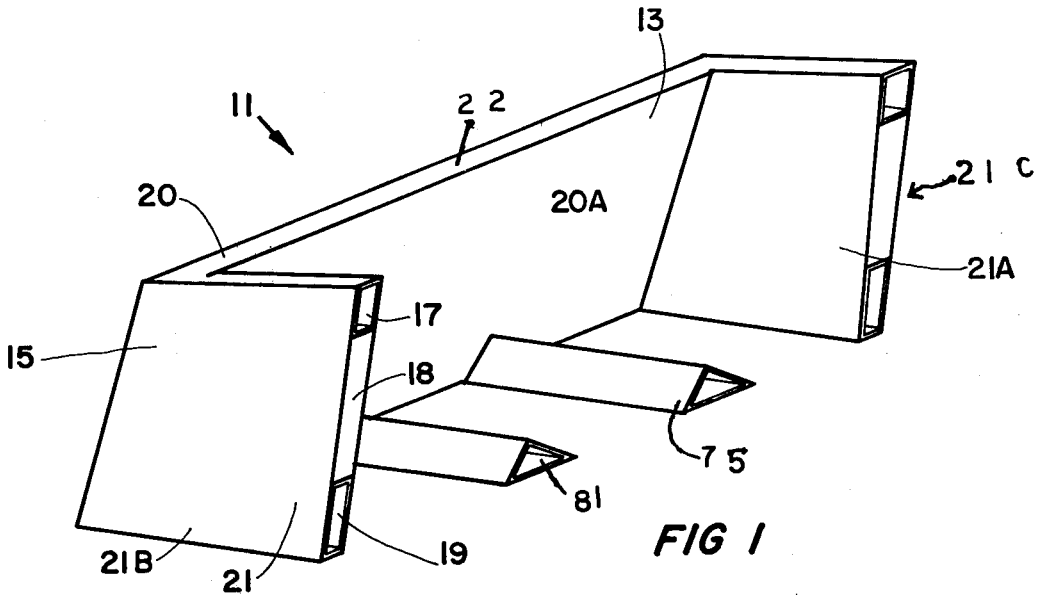
FIG. 1 is perspective view of one embodiment of this invention.

The invention of this application is seen to be an improvement of one version of the device disclosed and claimed by Austin U.S. Pat. No. 2,362,526 issued Nov. 14, 1944. Whereas in that patent a supplementary fan is required for dispersion of the heated air, the instant device does not require same. It is further to be seen that what is as when we disclosed here including the baffling system of the instant invention differs from that as disclosed in Austin. Another patent with which applicant is familiar is that of Andrews U.S. Pat. No. 3,762,391 assigned to Vega Industries, Inc. Applicant is also familiar with the products sold by said Vega Industries under the trademark HEATILTOR.

Referring to the drawings a device 11 is shown comprising a central section 20 having two spaced apart front and rear walls 20*a* and 20*b* respectively. The said front and rear walls extend vertically and optionally parallel relationship extending upwardly and forwardly from the bottom to the top thereof. Central section 20 is closed at its top and bottom 22, but is open at each of its ends. Central section 20 is intended to fit as close as possible against the rear wall of the fireplace in which the device 11 is inserted. A pair of side sections 21 are provided at either end of said central section 20 and in communication therewith. Said side sections are at an angle substantially a right angle or greater to the central section 20. Both the side sections are equidimensional unless a custom unit is designed due to a discrepancy in the construction of the fireplace. Taken as a whole, it is seen that device 11 comprises a continuous U shape chamber formed from side sections 21 with central section 20 interposed at the rear end of each of said side sections. Each of said side sections consists also of a pair of spaced apart generally vertical walls 21*a* and 21*b*, the spacing between each wall can optionally be uniform from the top to the bottom of each of said side sections. For ease of understanding, the inside wall would be inside of the U shape member forming device 11 is designated the inside wall 21*a*. The outside wall that abuts the side wall of the fireplace is denoted as the outside wall 21*b*. The forward wall or front of each of said side sections that faces into the room being heated and designated 21*c* consists of two openings interrupted by a panel between said openings. Top hole 17 and bottom hole 19 may be equidimensional or of different dimension. Panel 18 there between is preferably larger than the combined elevation of holes 17 and 19.

As previously indicated, the front and rear walls 20*a* and 20*b* of the central section can optionally be parallel to each other. It is preferred however that each should slope at a different rate in order to have a larger distance between the spaced apart panels at the top of the device. This allows for the expansion of the air upon heating. A typical elevation rate found satisfactory is 3" for 20" of elevation for the rear panel, and 4" for 20" in the front panel. Another benefit to be derived by having sloped panels as opposed to straight vertical panels is the fact that an individual device of this invention can be adapted for operation in more fireplaces, since generally speaking the rear wall of a fireplace slopes forwardly rather than being vertical. One further advantage of having sloping front and rear walls is the fact that the slope of the front wall can be adjusted to generally overhang the fire area within the fireplace thereby ensuring a maximum heat transfer from the burning logs, paper, etc. to the front wall of the central section of this device.

It is also to be seen that side sections 21 can be constructed with parallel inside and outside walls 21*a* and 21*b*, or they can diverge upwardly. Here again the advantage of the greater space between the walls at the top than at the bottom is to allow adequate room for the expansion of the heated air.

Section 21 are also closed at the top and bottom as inferred from above, but like section 20 they are open at their ends for communication with said central section in the rear, and for the entrance of air and the delivery of heated air at the bottom and top of the front wall 21C.

If the rear wall of the central section 20 is angularly disposed, the pitch of the rear of each side 21 should be at the same angle.

It is within the choice of the practitioner whether to have constructed side sections 21 to have a rear opening to an extended central sections (I), or to have an elongated side section with a shortened central section (II) and still achieve the same generally U-shaped chamber device 11. It is also contemplated to employ a mitered edge construction to give rise to an angular rear opening to communicate with the central section (III).

Figure 7:
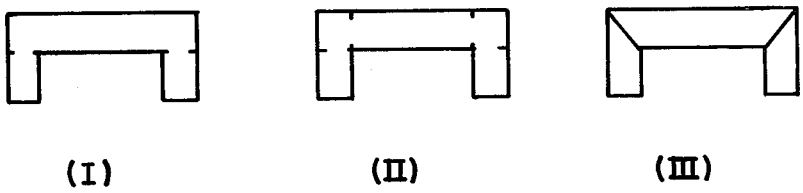
FIG. 7 is top plan view of various constructions.

As seen from the top, the generally U-shaped chamber can be shaped as described above and seen in FIG. 7.

The forward wall of said side section is generally vertical and forms a 90°± angle with the bottom of both the inside and outside walls 21*a* and 21*b* of said side section 21. The top of each of said side walls slopes rearwardly at a continuing angle that is the same angle of inclination of the top surface of the central section. Thus top 22 of the device 11 is seen to be a continuous uniplaner surface sloping from front to rear. The rear of said side section slopes upwardly and forwardly in a plane coextensive with the rear sloping wall of said central section 20. The bottom of device 11 is also uniplanar.

From the drawings therefore it is seen that each of said side sections is generally trapezoidal in configuration.

It is seen that sections 21 may be integrally formed as a part of a unitary device 11 in conjunction with central section 20, or each of said side sections can be formed separately and rigidly secured to said central section by screw or welding. It is also within the scope of this invention to fabricate said central section as a telescoping unit with suitable sealing means to prevent loss of heated air outwardly as well as the prevention of smoke or other gases inwardly into the trapped air within the chamber formed by 20*a*–20*b* and herein designated 13. Chamber 13 is in communication with chamber 15 at all times.

Disposed within each of said chambers 15 are a pair of air guides 71 and 73. Each air guide is mounted on the outside wall 21*b* generally at an incline. Said air guides 71 and 73 are disposed approximately one inch inward from the top opening 17 and from the bottom opening 19 in each of said side sections. For ease of understanding this invention, air guides 71 and 73 are only shown disposed in one of said side sections. However in actuality, they exist in both of said sections. Said air guides are mounted angularly whereby the guide 71 is disposed downwardly and rearwardly on the inside surface of the outside wall 21*b*. Air guide 73 is also recessed back from the rear edge of the wall 21*b* of said side section. For the purpose of reemphasizing and clarifying, front wall 16 consists of a panel 18 and two openings 17 and 19 respectively. Preferably each air guide is spaced apart from the interior surface of inside wall 21*a* in order to avoid any overheating of said guides and the possible buckling of same due to the unbalanced heating of the inside wall and the outside wall 21*a* and 21*b* respectively due to the normal positioning of the fire wood's fire that impinges upon device 11.

Disposed along the bottom of the central section 20 and in fluid communication therewith are air delivery tube 75. Each tube 75 may be configured circularly or as a triangle as shown in these figures. If triangular, then the largest side of said triangle should rest on the bottom of the fireplace with each of said sides being equidimensional. Said tubes 75 comprise a base portion and two upstanding side walls that are joined along the top edge thereof to form a triangular member. These delivery tubes 75 are open at the front end and at the rear end are inserted into suitably dimensioned apertures in the front wall 20*a* of central section 20. Each of said apertures is designated 77. In this manner, air entering the front aperture of said air delivery tubes is delivered to the chamber 13 of said central section 20.

In the second embodiment of this invention, a second set of air tubes 79 are employed for the delivery of heated air back into the room.

The device of the instant invention is designated a gravity fed invention in view of the fact that no force or motor is used to move the air from the bottom of the device to the top of the device for delivery and return back to the room being heated.

Each top air tube may also be triangular in configuration and is to be in fluid communication with suitable 77T apertures in the front wall 20*a* of central section 20.

Whereas the air delivery tubes are in a plane generally horizontal to the base of the fireplace, which itself should be and preferably is horizontal, the air egress top tubes are positioned at an angle slightly upwardly such that air may be delivered to an area equal to or higher than the delivery area of air emerging from the top of each of said side sections 21 through openings 17. Supporting each of said air egress tubes, not only for weight purposes but also to maintain the desired angle delivery of the warm air, is smoke shield 83. Smoke shield 83 is suitably notched to receive each air egress tube therein whereby the air egress tube is maintained in a fixed relationship preferably parallel to the other top tubes.

Whereas in said Austin patent the side walls are intended to abut the side walls of the fireplace, the instant unit is intended to be positioned close to, but not necessarily exactly up against the side wall of the fireplace, in this manner, the device 11 can be employed with fireplaces of different dimensions. Of course it is desired that the device 11 be designed relatively close to the dimensions of the fireplace for maximum efficiency and for maximum return of heated air. However unlike the prior art unit this unit is not intended to be maintained ridgedly in place and does not bolt or affix in any manner to the walls of the fireplace. In fact, the instant unit is intended to be removed for cleaning, maintainance and any other purpose as may be desired. Accordingly, no front hinge means or grill work is provided since the device is intended to be strictly functional. However, for aesthetic purposes apertures 17 and 19 in the front sections may be covered with a perforated material not only to prevent hands and other objects from being inserted into the chamber, but also for aesthetic purposes.

Smoke shield 83 mentioned previously may be suitably attached to each inside wall 21 of said side sections and may be formed of a flat plate or round stock at the convenience of the practitioner. Smoke shield 83 may be secured to each of said air egress tubes as by welding if desired, or depending upon the configuration of the air egress tube and the nature of the material employed ie. flat stock, bar stock or the like for said smoke shield, the tubes 79 may merely rest upon but not necessarily be secured to said smoke shield 83.

The efficiency of the device of this invention can be improved by adding a supplementary fan to aid in air direction. The fan means comprises a fan generally designated as a squirrel cage fan 51 in combination with a plenum 52. While any fan may be employed, a squirrel cage fan operates quieter. The plenum 52 is a closed chamber having a left end panel **53*c*, two upstanding spaced apart front and back elongated panels 53*b* and 53*b'*, and a top and bottom 53*a* panel. The opening for the fan at the right side is designated 53*d***. This is sized to match the fan such that fan output aim is not wasted by not going down the plenum.

Rear panel **53*b'* has a plurality of spaced apart apertures therein sized and shaped to match the two air inlets 19 of side section 21 and the two air inlet tubes 75. These apertures are designated from left to right 57, 56, 55 and 54 respectively. Suitable sealing means not shown should be employed to ensure a tight fit between the plenum 52 and the device 11. Of course the fan can be located on the left side with panel 53*c*** on the right.

When building a fire it is recommended that long branches be employed which are positioned parallel to the air delivery tubes 75 which tubes are normally disposed parallel to each other and in the same vertical and horizontal planes, whereby the unit will be able to achieve a maximum efficiency and heating of the air. In operation it is seen that in the embodiment of FIG. 1 that the heated air coming in from tubes 75 is delivered back to the room to be heated only by way of top opening 17 of each of said side sections 21. Whereas in the embodiment of FIG. 2 such hot air may be delivered either through opening 17 as well as through the front opening 85 in air egress tube 79.

Figure 2:
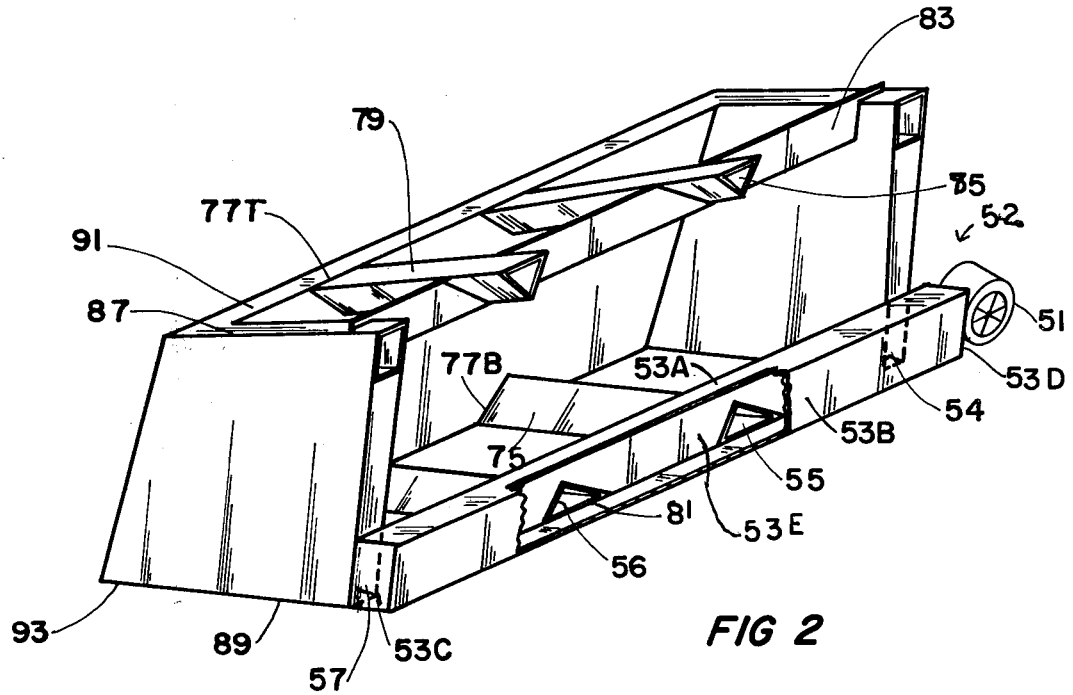
FIG. 2 is a perspective view of a second embodiment of this invention.
Figure 3:
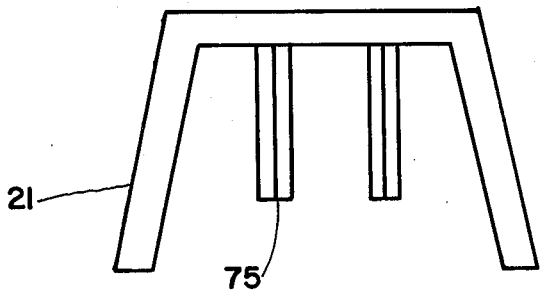
FIG. 3 is a top plan view of the embodiment of FIG. 1.
Figure 4:
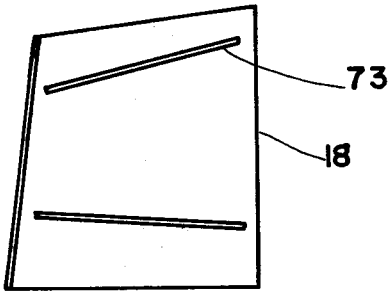
FIG. 4 is a side elevational view of one portion of this invention.
Figure 5:
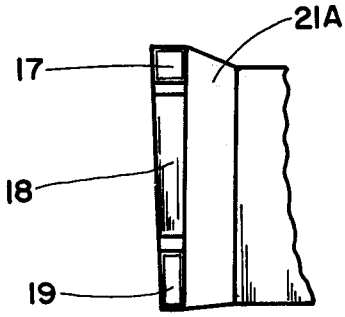
FIG. 5 is a front close-up view of the left arm of the unit as found in both embodiments of this invention.
Figure 6:
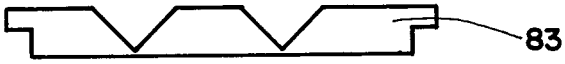
FIG. 6 is a front elevational view of the smoke shield.

Whereas in FIGS. 1 and 2 the side sections 21 are shown to be substantially parallel to each other, it is also seen especially from top plane view FIG. 3, that each of said side sections may be disposed depending away from the central section 20. Such configuration as seen from FIG. 3 would more typically conform to the modern construction of fireplaces.

It is believed that metal preferably of 12 or 14 gauge sheet stock should be employed in the fabrication of **20*a*; 21*a* and tubes 75. For lower costs of construction, the gauge of the metal of the outside walls of said device 11** ie. those walls closest to the backs of the fireplace per se, may be of 22 gauge or thinner.

In tests conducted utilizing a standard 8500 BTU chemically treated sawdust log, it was found that more than 11,000 BTU's of heat entered the room as the result of the employment of the instant device. This is heated air that is delivered to the room that which would not be delivered to the room if said device were not employed. The air that is heated for delivery to the room tends to rise in the room as a result of the fact that it is less dense than the balance of the air in the room. The device of the instant invention is considered to be a gravity air device as opposed to a forced air type of device.

When the device 11 is fabricated as a one-piece unit, standard construction techniques may be employed for holding and joining of the various metal pieces. These techniques include overlapping of seams and the use of sheetmetal screws or preferably welds to ensure no air leakage. However when the side sections are designed to be removable from the center section 20, then a double folded junction should be employed. Such a double fold will ensure tight fit of the side section into the rear section such as to prevent leakage of heated air. The use of such double folded construction is well known to the sheetmetal art.

Optionally there may be employed a forced air 52 means comprising a plenum 53 in combination with a fan 51. Such a combination is shown present in conjunction with the embodiment of this invention in FIG. 2. This forced air means 52 comprises a fan 51, here a "squirrel cage" fan which operates at a low noise level and is disposed at the open end **53*d* of plenum 53**. Suitable sealing means and any necessary sheet metal to ensure no wasteage of forced air are within the shell of the art and are not shown in this figure.

Plenum 53 which is generally a rectangular chamber usually of sheet metal construction having a closed end **53*c*, a top 53*a*, front 53*b*, a bottom similar to the top 53*a*, and a rear wall 53*e* similar to the front wall except for the presence of a plurality of apertures 54, 55, 56 and 57 shaped to be of the same configuration as openings 19 and 81, the openings in the sides 21 and air delivery tubes 75 respectively. The apertures 54, 55, 56 and 57** are slightly larger than the openings of the sections and tubes that abut them and are suitably sealed to prevent air leakage, the plenum is in fluid communication with the side sections and the air delivery tubes.

Air forced from fan 51 goes down plenum 53 and enters the four openings to device 11 as is shown in FIG. 2

Optionally as may be desired, but not shown in the Figures, apertures 19 may be sealed off such that forced air enters only the apertures 81 in tubes 75.

Since the use of the forced air means 52 is optional, it is to be seen that such a means can also be employed with the embodiment of the invention shown in FIG. 1.

What is claimed is:

1. An air heating device for a fireplace comprising a hollow central section constructed and arranged to fit adjacent the rear wall of said fireplace in an upstanding manner, said central section having a front and rear wall, and two openings at the bottom of the front wall, and two openings at the top of the front wall thereof, two side hollow sections each attached to said central section and in fluid communication therewith, each of said side sections having a front wall comprising top and bottom openings with a solid panel therebetween, and, an inside wall and an outside wall, thereby defining a generally U-shaped hollow chamber, two lower air delivery tubes secured to the front wall of said central section at the bottom openings therein, said tubes being in fluid communication with said hollow central section, whereby air will pass into the lower openings of each of said side sections and out of the top openings of each of said side sections, and air will enter said hollow chamber through said air delivery tubes;

two top air delivery tubes secured onto the front wall of said central section, one at each opening at the top of said front wall, each top air delivery tube being in fluid communication with the hollow chamber.

2. In the device of claim 1 wherein a smoke shield is rigidly secured at the top of each side section and is disposed in an axis parallel to the front wall of the center section between the two side sections.

3. The device of claim 1 wherein the top wall of each of said side sections and said central sections slopes downwardly and rearwardly from the front of each of said sections.

4. In the device of claim 1 wherein at least two of said lower air delivery tubes are secured at a right angle to the front wall of said central section at openings therein, and parallel to each other.

5. In the device of claim 1 wherein at least two of said top air delivery tubes are secured at a right angle to opening in the top of the front wall at openings therein, and parallel to each other.

6. In the device of claim 5 wherein each of said top air delivery tubes is triangularly configured, and each tube rests in a V-shaped notch in said smoke shield.

7. In the device of claim 1, wherein the front and rear walls of said center section slope upwardly and forwardly.

8. In the device of claim 7, wherein said walls slope forwardly at different rates, whereby the central section is wider at the top than at the bottom.

9. In the device of claim 8, wherein the inside and outside walls of each side section diverge upwardly.

10. In the device of claim 2 wherein each of said top air delivery tubes is rigidly secured to said smoke shield.

11. In the device of claim 1 including a plenum having openings therein in fluid communication with the lower air delivery tubes and the bottom openings of said side sections.

12. In the device of claim 11 further including an intake fan in fluid communication with said plenum.

13. In the device of claim 11 wherein each of said top air delivery tubes is triangularly configured, and each tube rests in a V-shaped notch in said smoke shield, wherein the front and rear walls of said center section slope upwardly and forwardly at different rates, whereby the central section is wider at the top than at the bottom and wherein the inside and outside walls of each side section diverge upwardly.

* * * * *